US007285080B1

(12) United States Patent
Chiu

(10) Patent No.: US 7,285,080 B1
(45) Date of Patent: Oct. 23, 2007

(54) EXERCISING DEVICE HAVING COMBINATION OF BALL AND ROD

(76) Inventor: Ciber Chiu, 54-6, Chi Parn Lane, Gou Cheng Li, Lu Kang, Changhua Hsien (TW)

( * ) Notice: Subject to any disclaimer, the term of this patent is extended or adjusted under 35 U.S.C. 154(b) by 0 days.

(21) Appl. No.: 11/416,486

(22) Filed: May 2, 2006

(51) Int. Cl.
*A63B 26/00* (2006.01)

(52) U.S. Cl. ..... 482/142

(58) Field of Classification Search ..... 482/140, 482/907, 91; 446/220
See application file for complete search history.

(56) References Cited

U.S. PATENT DOCUMENTS 5,980,256 A * 11/1999 Carmein ..... 434/55
6,068,580 A * 5/2000 Myers et al. ..... 482/93
7,118,517 B1 * 10/2006 Hale ..... 482/140
2001/0001094 A1 * 5/2001 Panes ..... 482/93

* cited by examiner

*Primary Examiner*—Lori Amerson
(74) *Attorney, Agent, or Firm*—Alan Kamrath; Kamrath & Associates P.A.

(57) ABSTRACT

An exercising device includes a ball, and a rod extended through the ball. Thus, the ball has a periphery formed with two through holes each having a peripheral wall formed with a pressing lip which presses the rod closely after the ball is inflated to form a sealing effect to seal the chamber of the ball to maintain the air in the chamber of the ball, so that the ball is sealed on the rod exactly without incurring air leakage. In addition, the manufacturer only needs to form two through holes in the periphery of the ball without having to form a hollow channel which is extended through the whole diameter of the ball, thereby facilitating fabrication of the ball, and thereby decreasing costs of fabrication.

17 Claims, 10 Drawing Sheets

EXERCISING DEVICE HAVING COMBINATION OF BALL AND ROD

BACKGROUND OF THE INVENTION

1. Field of the Invention

The present invention relates to an exercising device and, more particularly, to an exercising device having combination of a ball and a rod.

2. Description of the Related Art

A conventional exercising device in accordance with the prior art shown in FIG. 10 comprises a ball 70 made of rubber material. Thus, a user can use the exercising device by placing his body on the ball 70 so as to massage or stretch his body by the ball 70, thereby achieving the exercising and massaging effects.

Another conventional exercising device comprises a ball having an inside formed with a hollow channel which is extended through the whole diameter of the ball, and a rod extended through the hollow channel of the ball. Thus, a user can use the exercising device by holding the rod with his two hands and by placing his body on the ball so as to massage or stretch his body by the ball, thereby achieving the exercising and massaging effects. However, the manufacturer needs to form a hollow channel which is extended through the whole diameter of the ball, thereby causing inconvenience in fabrication of the ball, and thereby increasing costs of fabrication.

BRIEF SUMMARY OF THE INVENTION

In accordance with the present invention, there is provided an exercising device, comprising a ball having a periphery formed with two radially opposite through holes each having a peripheral wall formed with a protruding pressing lip, and a rod extended through the ball and having two opposite ends each extended through the respective through hole of the ball and each pressed by the pressing lip of the respective through hole.

The primary objective of the present invention is to provide an exercising device having combination of a ball and a rod.

Another objective of the present invention is to provide an exercising device, wherein the ball has a periphery formed with two through holes each having a peripheral wall formed with a pressing lip which presses the rod closely after the ball is inflated to form a sealing effect to seal the chamber of the ball to maintain the air in the chamber of the ball, so that the ball is sealed on the rod exactly without incurring air leakage.

A further objective of the present invention is to provide an exercising device, wherein the manufacturer only needs to form two through holes in the periphery of the ball without having to form a hollow channel which is extended through the whole diameter of the ball, thereby facilitating fabrication of the ball, and thereby decreasing costs of fabrication.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
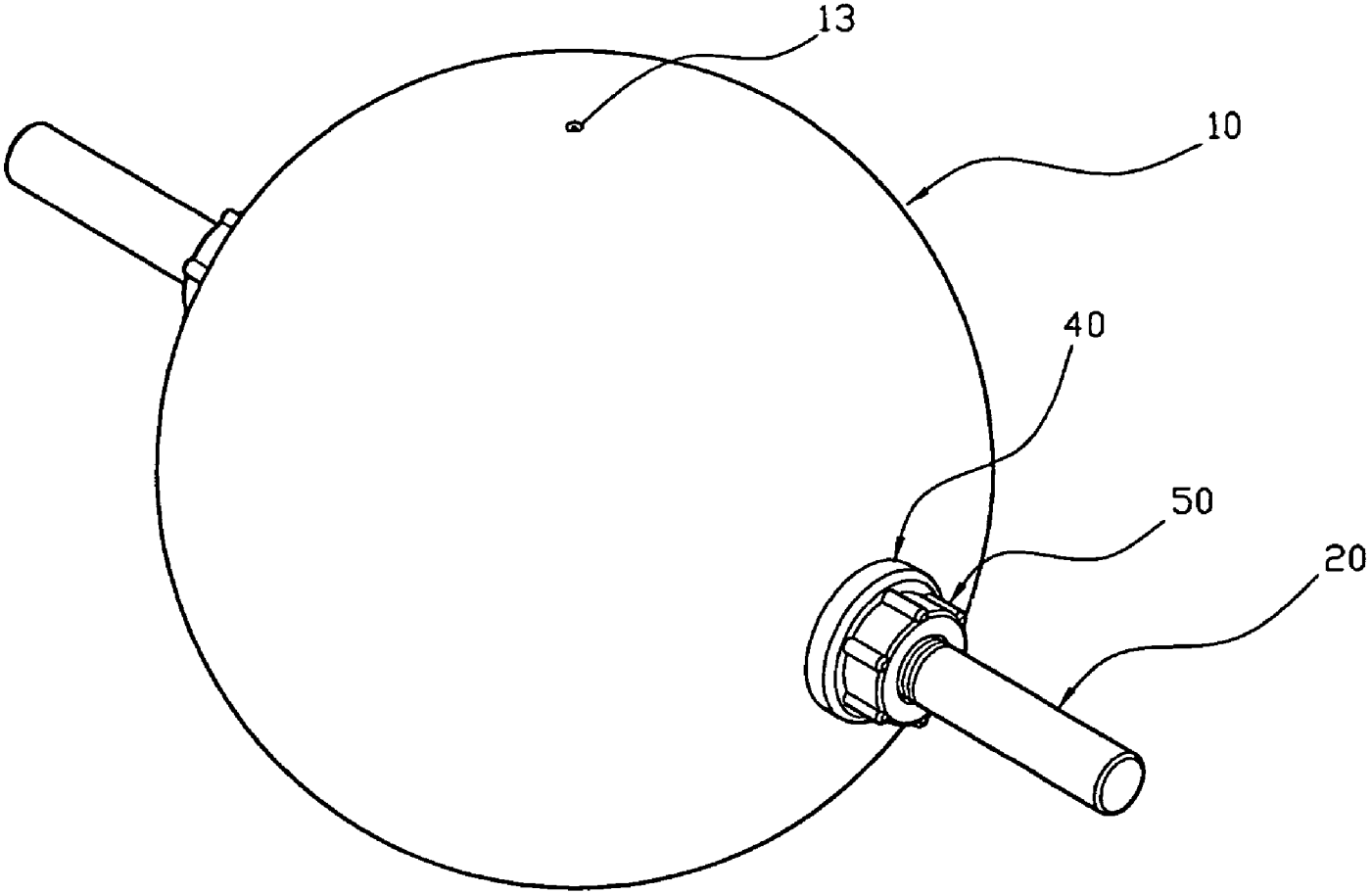
FIG. 1 is a perspective view of an exercising device in accordance with the preferred embodiment of the present invention.
Figure 2:
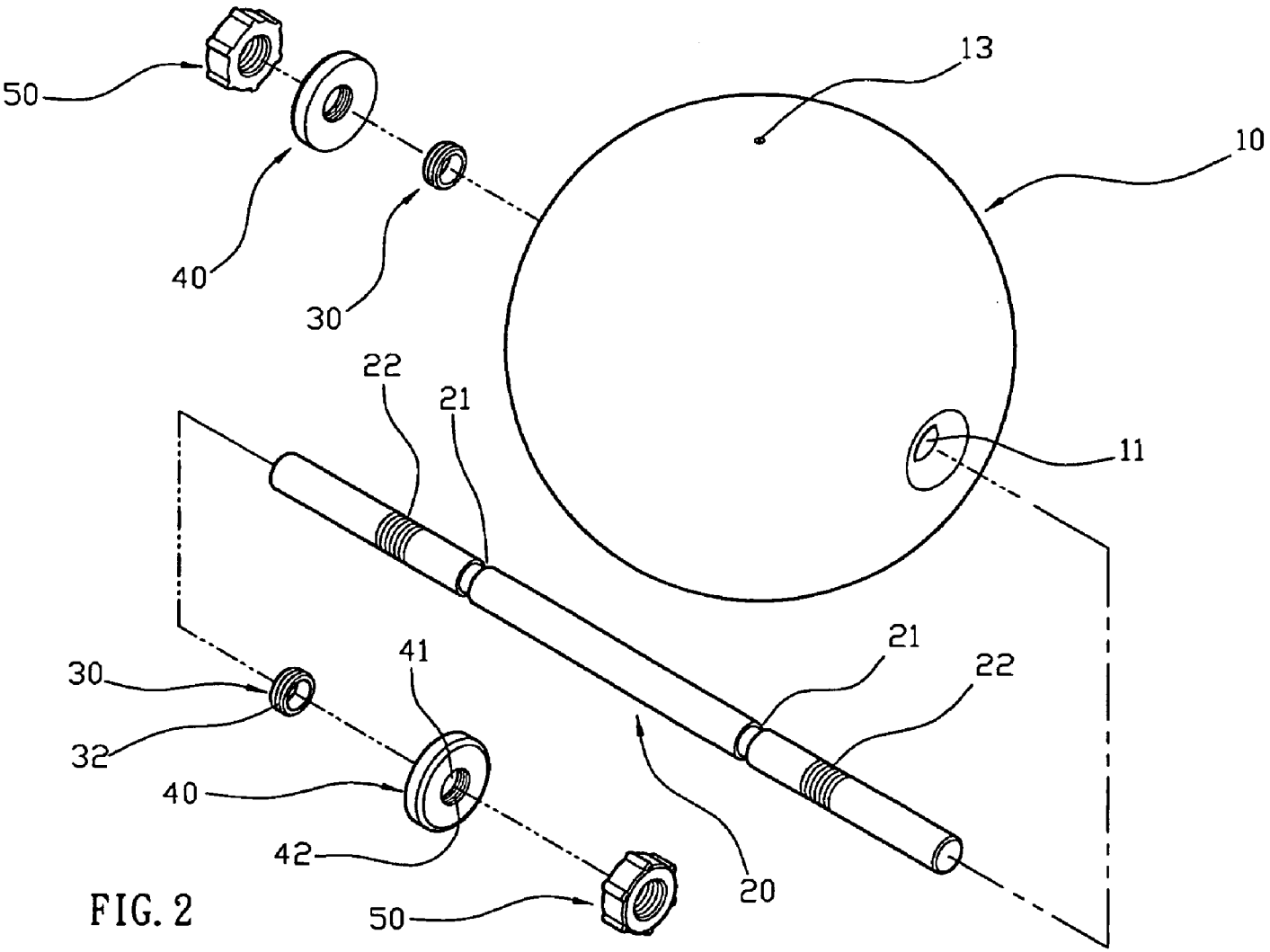
FIG. 2 is an exploded perspective view of the exercising device as shown in FIG. 1.
Figure 3:
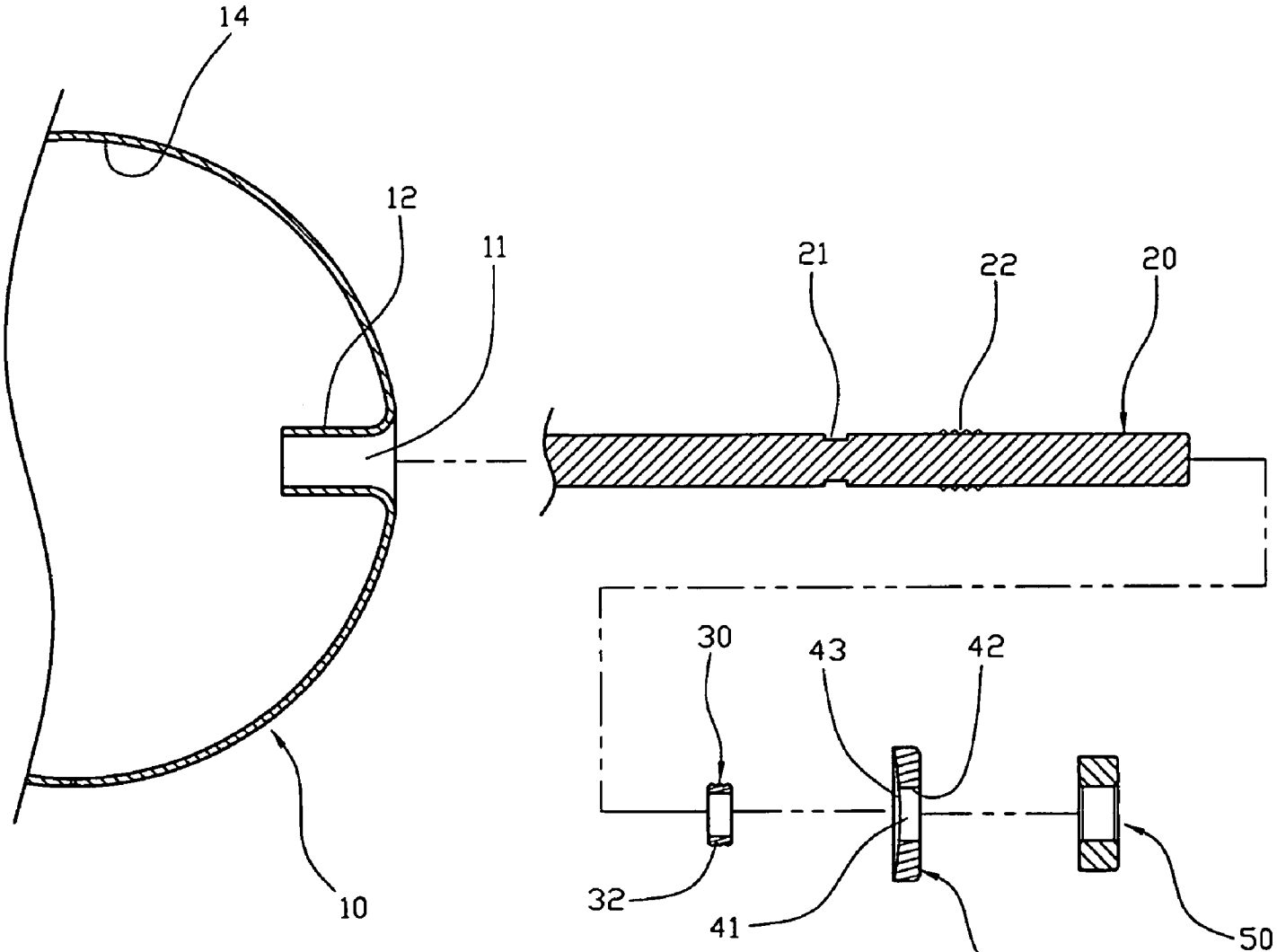
FIG. 3 is a partially plan exploded cross-sectional view of the exercising device as shown in FIG. 1.
Figure 4:
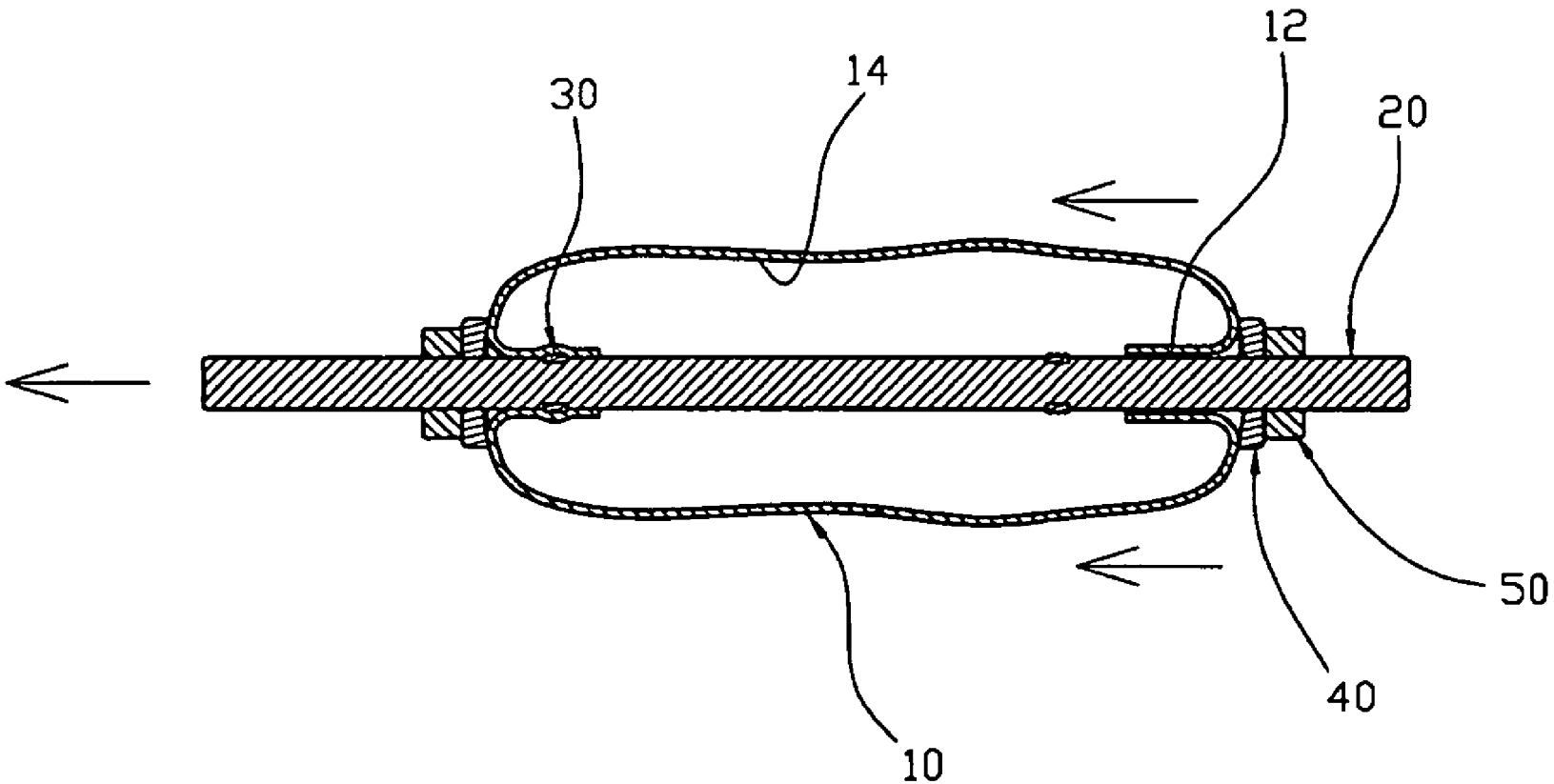
FIG. 4 is a plan cross-sectional view of the exercising device, wherein the ball is deflated.
Figure 5:
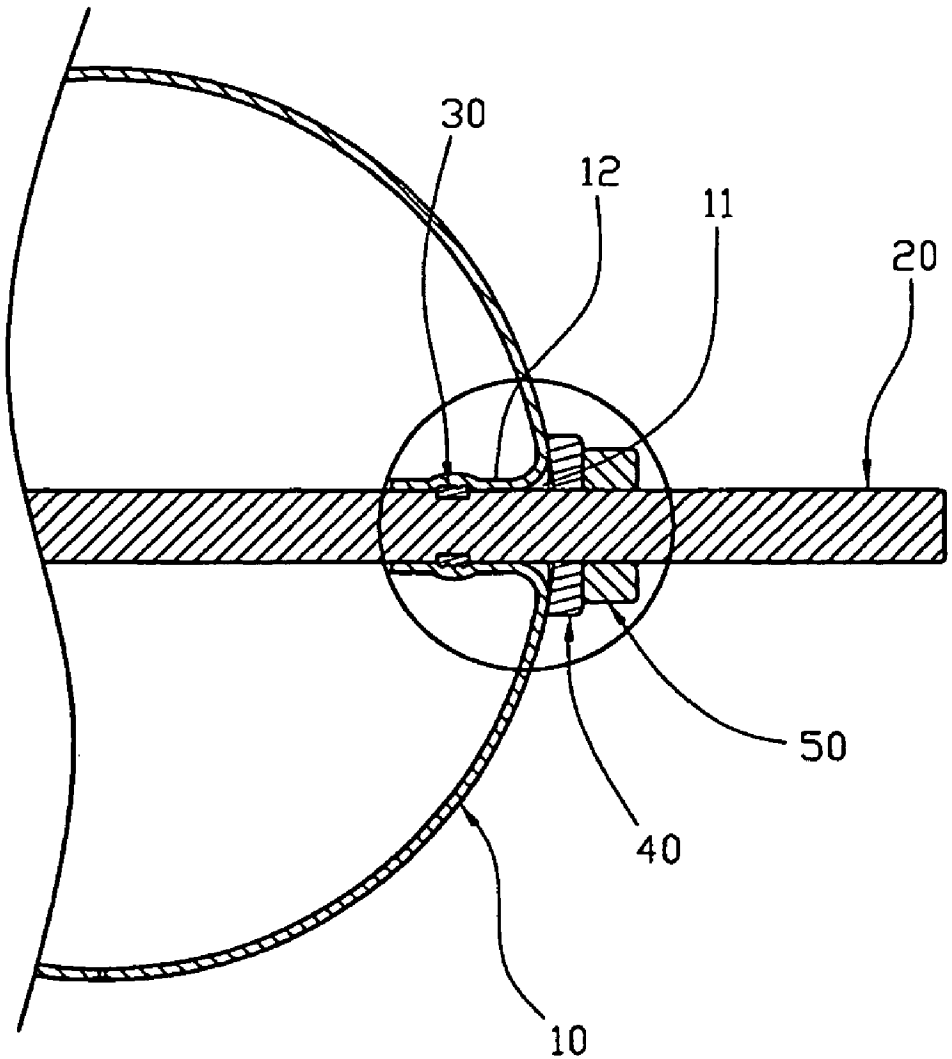
FIG. 5 is a partially plan cross-sectional view of the exercising device as shown in FIG. 1.
Figure 6:
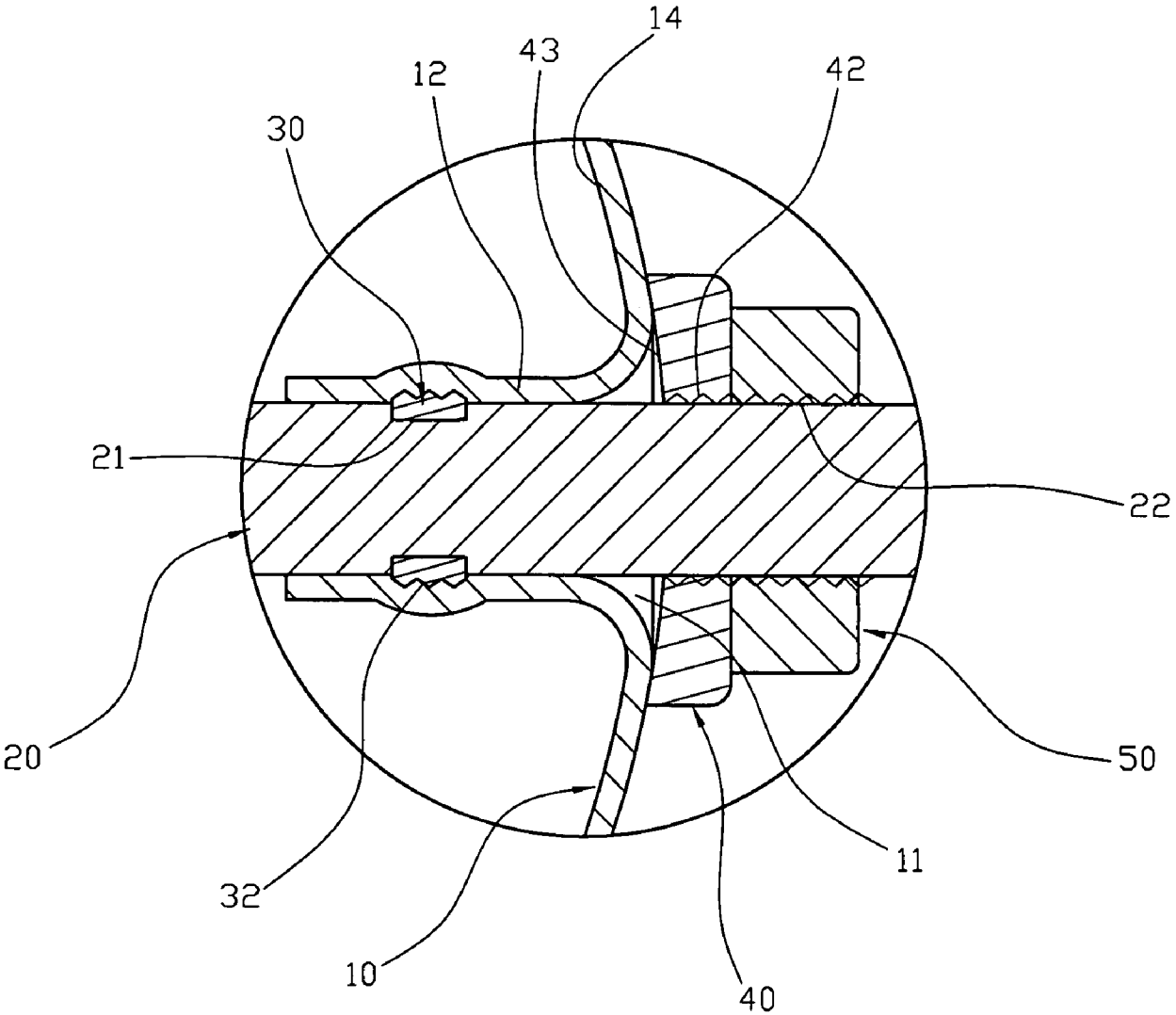
FIG. 6 is a locally enlarged view of the exercising device as shown in FIG. 5.

Referring to the drawings and initially to FIGS. 1-6, an exercising device in accordance with the preferred embodiment of the present invention comprises a ball 10 having a periphery formed with two radially opposite through holes 11 each having a peripheral wall formed with a protruding pressing lip 12, and a rod 20 extended through the ball 10 and having two opposite ends each extended through the respective through hole 11 of the ball 10 and each pressed by the pressing lip 12 of the respective through hole 11.

The ball 10 is made of an inflatable rubber and has an inside formed with a chamber 14 connected to each of the through holes 11. The periphery of the ball 10 is formed with an air nozzle 13 connected to the chamber 14 to fill air into the chamber 14 so as to inflate the ball 10. The pressing lip 12 of each of the through holes 11 of the ball 10 extends inwardly toward a central portion of the ball 10.

The rod 20 is extended through each of the through holes 11 of the ball 10 in a closely fit manner and clamped by the pressing lip 12 of each of the through holes 11 before the ball 10 is inflated. The pressing lip 12 of each of the through holes 11 of the ball 10 presses the rod 20 closely after the ball 10 is inflated to form a sealing effect to seal the chamber 14 of the ball 10 to maintain the air in the chamber 14 of the ball 10. Each of the two ends of the rod 20 is formed with a positioning groove 21 and provided with an outer thread 22 located outside of the positioning groove 21.

The exercising device further comprises two sealing rings 30 each mounted on the rod 20 and each urged on an inner wall of the pressing lip 12 of the respective through hole 11 of the ball 10, two pressing rings 40 each mounted on the rod 20 and each urged on the peripheral wall of the respective through hole 11 of the ball 10 to position the ball 10 on the rod 20, and two locking screws 50 each mounted on the rod 20 and each urged on the respective pressing ring 40 to push the respective pressing ring 40 toward the respective through hole 11 of the ball 10.

Each of the sealing ring 30 is secured in the respective positioning groove 21 of the rod 20 and has an outer wall provided with a serrated portion 21 engaged with the inner wall of the pressing lip 12 of the respective through hole 11 of the ball 10.

Each of the pressing rings 40 has an inner wall formed with a mounting hole 41 mounted on the rod 20. The mounting hole 41 of each of the pressing rings 40 is provided with an inner thread 42 screwed onto the respective outer thread 22 of the rod 20. Each of the pressing rings 40 has a side formed with a substantially arc-shaped resting face 43 rested on the peripheral wall of the respective through hole 11 of the ball 10.

Each of the locking screws 50 is screwed onto the respective outer thread 22 of the rod 20.

As shown in FIG. 1, the ball 10 is positioned on the rod 20, so that a user can use the exercising device by holding the rod 20 with his two hands and by placing his body on the ball 10 so as to massage or stretch his body by the ball 10, thereby achieving the exercising and massaging effects.

Figure 7:
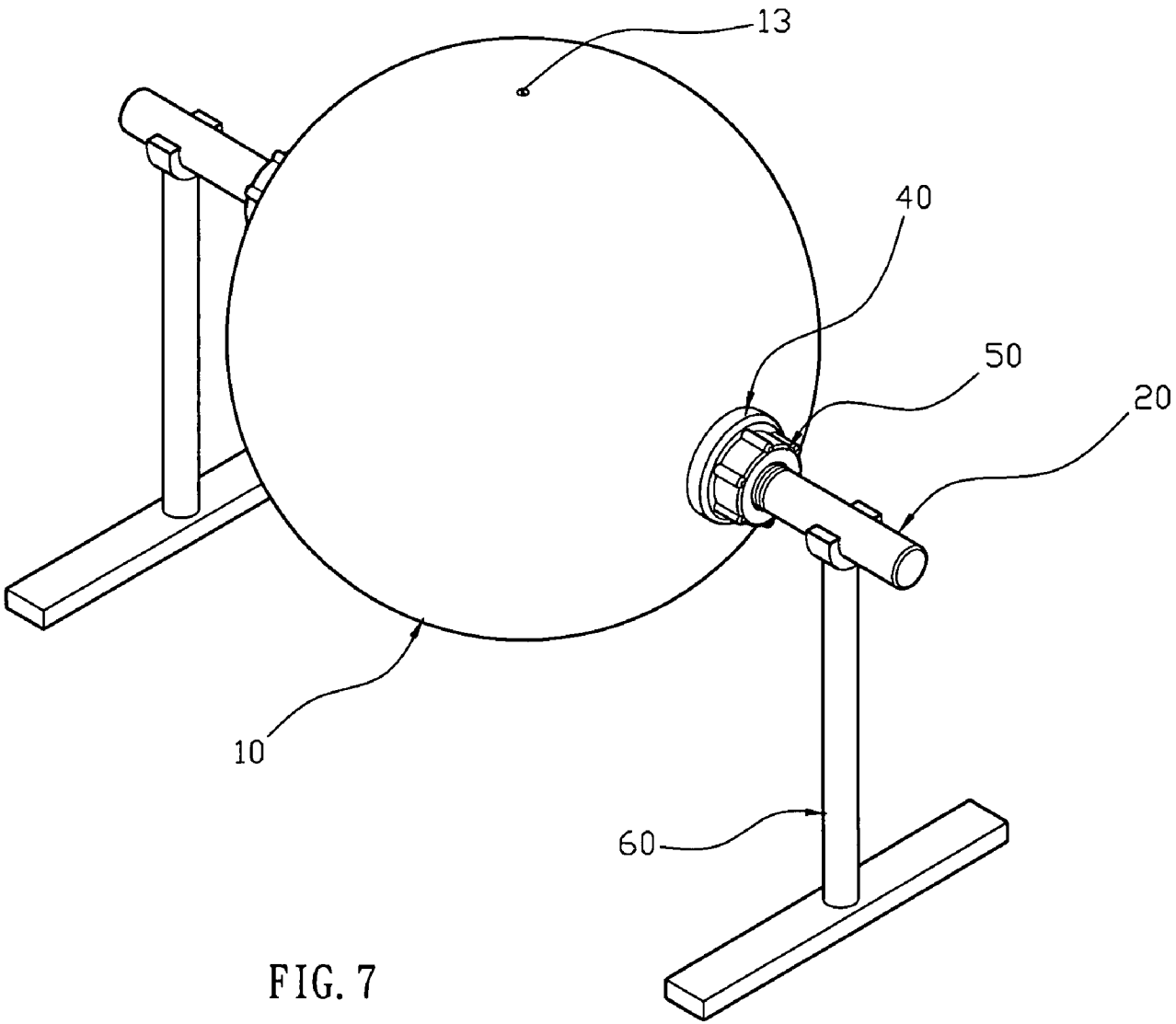
FIG. 7 is a perspective operation view of the exercising device as shown in FIG. 1.

As shown in FIG. 7, the rod 20 is mounted on a support rack 60 to facilitate the user operating the exercising device.

Figure 8:
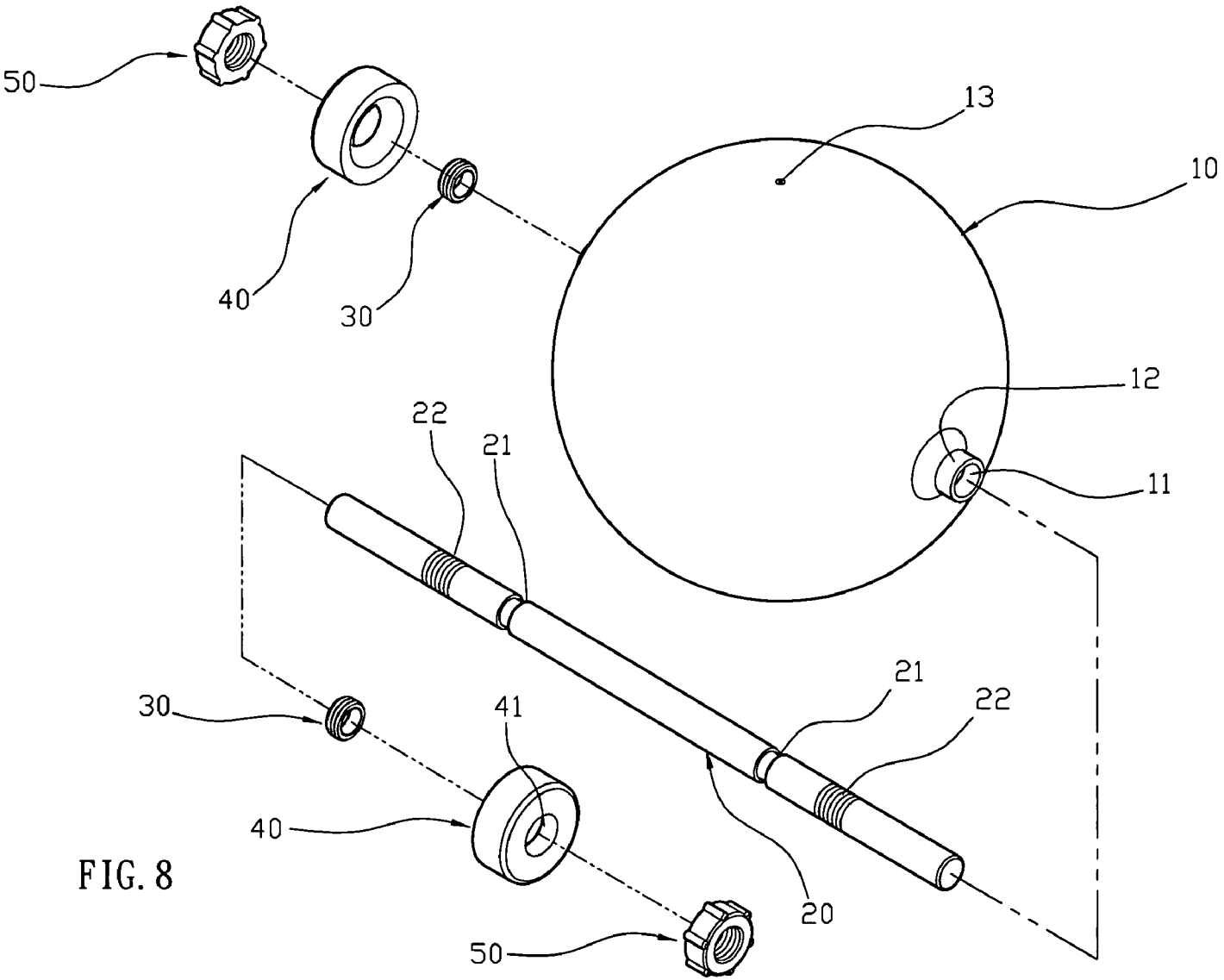
FIG. 8 is an exploded perspective view of an exercising device in accordance with another preferred embodiment of the present invention.
Figure 9:
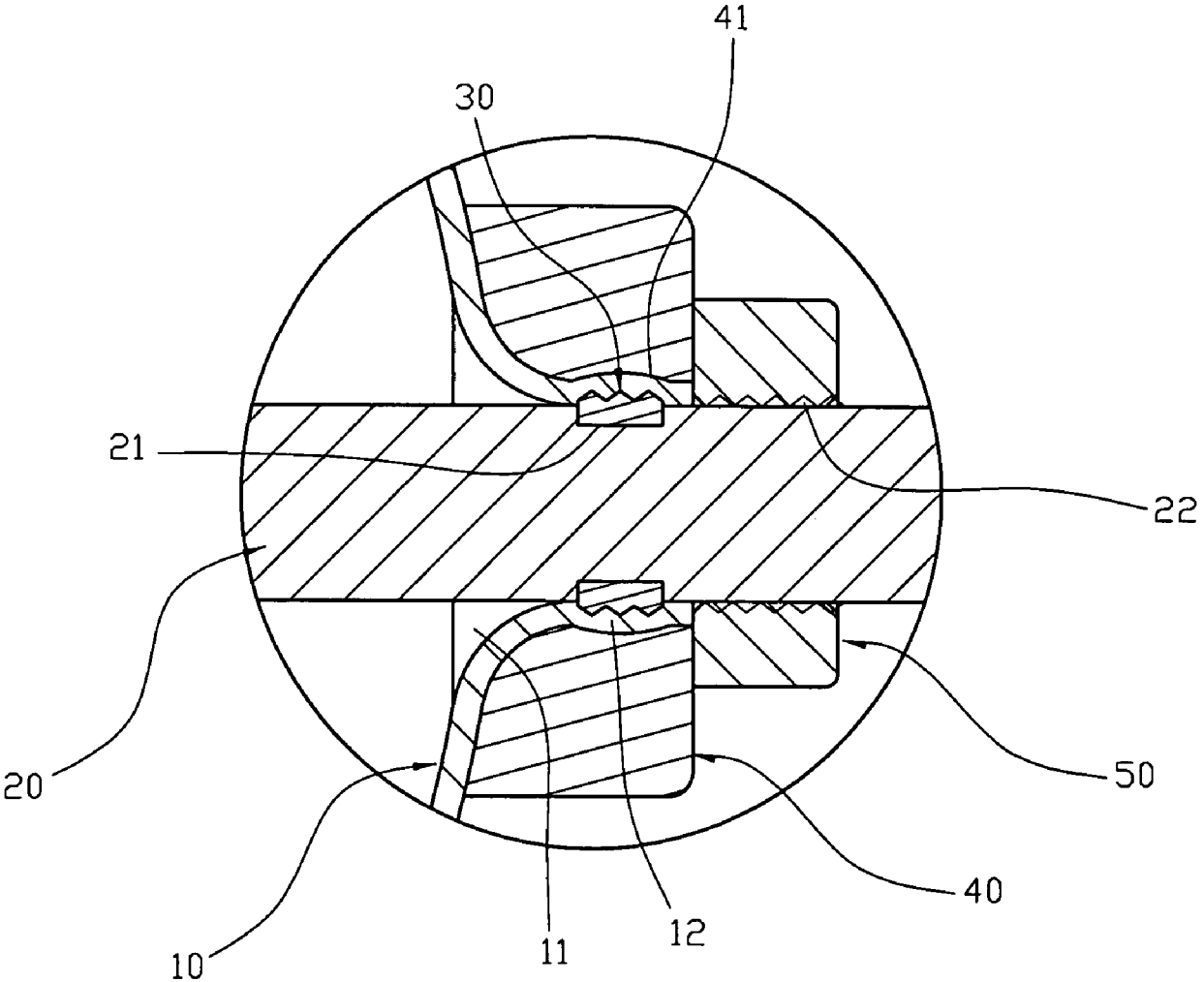
FIG. 9 is a partially plan cross-sectional assembly view of the exercising device as shown in FIG. 8.
Figure 10:
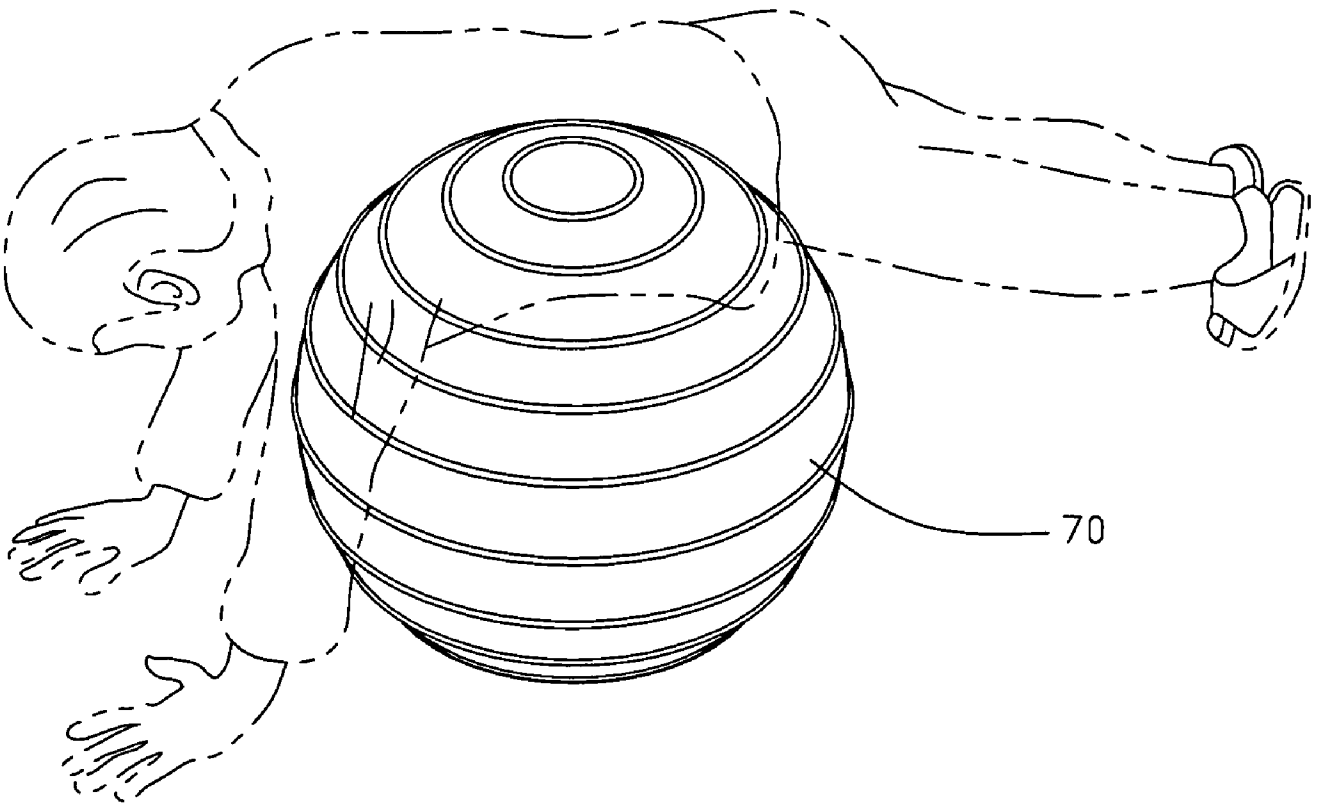
FIG. 10 PRIOR ART
FIG. 10 is a perspective operational view of a conventional exercising device in accordance with the prior art.

Referring to FIGS. 8 and 9, the pressing lip 12 of each of the through holes 11 of the ball 10 extends outwardly from the periphery of the ball 10. Each of the pressing rings 40 is urged on an outer wall of the pressing lip 12 of the respective through hole 11 of the ball 10 to position the ball 10 on the rod 20. The mounting hole 41 of each of the pressing rings 40 is rested on the outer wall of the pressing lip 12 of the respective through hole 11 of the ball 10.

Accordingly, the ball 10 has a periphery formed with two through holes 11 each having a peripheral wall formed with a pressing lip 12 which presses the rod 20 closely after the ball 10 is inflated to form a sealing effect to seal the chamber 14 of the ball 10 to maintain the air in the chamber 14 of the ball 10, so that the ball 10 is sealed on the rod 20 exactly without incurring air leakage. In addition, the manufacturer only needs to form two through holes 11 in the periphery of the ball 10 without having to form a a hollow channel which is extended through the whole diameter of the ball 10, thereby facilitating fabrication of the ball 10, and thereby decreasing costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device, comprising:

a ball having a periphery formed with two radially opposite through holes each having a peripheral wall formed with a protruding pressing lip;

wherein the pressing lip of each of the through holes of the ball extends inwardly toward a central portion of the ball;

a rod extended through the ball and having two opposite ends each extended through the respective through hole of the ball and each pressed by the pressing lip of the respective through hole;

two pressing rings each mounted on the rod and each urged on the peripheral wall of the respective through hole of the ball to seal the respective through hole of the ball and to position the ball on the rod.

2. The exercising device in accordance with claim 1, wherein the rod is extended through a whole diameter of the ball;

the rod is extended through each of the through holes of the ball in a closely fit manner and clamped by the pressing lip of each of the through holes before the ball is inflated.

3. The exercising device in accordance with claim 2, wherein the pressing lip of each of the through holes of the ball presses the rod closely after the ball is inflated to form a sealing effect to seal an inside of the ball.

4. The exercising device in accordance with claim 1, further comprising two sealing rings each mounted on a peripheral wall of the rod and each urged on an inner wall of the pressing lip of the respective through hole of the ball to provide a sealing effect between the rod and the pressing lip of the respective through hole of the ball to seal the respective through hole of the ball.

5. The exercising device in accordance with claim 4, wherein each of the two ends of the rod is formed with an annular positioning groove, and each of the sealing ring is secured in the respective positioning groove of the rod.

6. The exercising device in accordance with claim 4, wherein each of the sealing ring has an outer wall provided with a serrated portion extended through a whole length of each of the sealing ring and engaged with the inner wall of the pressing lip of the respective through hole of the ball.

7. The exercising device in accordance with claim 1, wherein each of the pressing rings has a side formed with a substantially arc-shaped resting face rested on the peripheral wall of the respective through hole of the ball to seal the respective through hole of the ball.

8. The exercising device in accordance with claim 1, wherein each of the pressing rings has an inner wall formed with a mounting hole mounted on the rod.

9. The exercising device in accordance with claim 1, wherein each of the two ends of the rod is provided with an outer thread, and the mounting hole of each of the pressing rings is provided with an inner thread screwed onto the respective outer thread of the rod.

10. The exercising device in accordance with claim 1, further comprising two locking screws each mounted on the rod and each urged on the respective pressing ring to push the respective pressing ring toward the respective through hole of the ball to seal the respective through hole of the ball and to position the ball on the rod.

11. The exercising device in accordance with claim 10, wherein each of the two ends of the rod is provided with an outer thread, and each of the locking screws is screwed onto the respective outer thread of the rod.

12. The exercising device in accordance with claim 1, wherein the rod is mounted on a support rack.

13. An exercising device, comprising:

a ball having a periphery formed with two radially opposite through holes each having a peripheral wall formed with a protruding pressing lip;

wherein the pressing lip of each of the through holes of the ball extends outwardly from the periphery of the ball;

a rod extended through the ball and having two opposite ends each extended through the respective through hole of the ball and each pressed by the pressing lip of the respective through hole;

two pressing rings each urged on an outer wall of the pressing lip of the respective through hole of the ball to position the ball on the rod, wherein the pressing lip of the respective through hole of the ball is located between each of the pressing rings and the rod.

14. The exercising device in accordance with claim 13, wherein each of the pressing rings has an inner wall formed with a mounting hole rested on the outer wall of the pressing lip of the respective through hole of the ball.

15. The exercising device in accordance with claim 13, further comprising two locking screws each mounted on the rod and each urged on the respective pressing ring to push the respective pressing ring toward the respective through hole of the ball to seal the respective through hole of the ball and to position the ball on the rod.

16. The exercising device in accordance with claim 15, wherein each of the two ends of the rod is provided with an outer thread, and each of the locking screws is screwed onto the respective outer thread of the rod to rest on the respective pressing ring and the pressing lip of the respective through hole of the ball.

17. The exercising device in accordance with claim 1, wherein the ball is made of an inflatable rubber and has an inside formed with a chamber connected to each of the through holes, and the periphery of the ball is formed with an air nozzle connected to the chamber.

* * * * *